US009644875B2

(12) United States Patent
Ito et al.

(10) Patent No.: US 9,644,875 B2
(45) Date of Patent: May 9, 2017

(54) AIR-CONDITIONING SYSTEM AND HUMIDITY CONTROL DEVICE

(75) Inventors: Shinichi Ito, Chiyoda-ku (JP); Masaki Toyoshima, Chiyoda-ku (JP); Fumitake Unezaki, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 470 days.

(21) Appl. No.: 13/882,614

(22) PCT Filed: Dec. 22, 2010

(86) PCT No.: PCT/JP2010/007430

§ 371 (c)(1),
(2), (4) Date: Apr. 30, 2013

(87) PCT Pub. No.: WO2012/085969

PCT Pub. Date: Jun. 28, 2012

(65) Prior Publication Data

US 2013/0213079 A1 Aug. 22, 2013

(51) Int. Cl.

| | |
|---|---|
| ***F25B 49/02*** | (2006.01) |
| ***F24F 3/14*** | (2006.01) |
| ***F25B 13/00*** | (2006.01) |

(52) U.S. Cl.

CPC ..... *F25B 49/02* (2013.01); *F24F 3/1411* (2013.01); *F25B 13/00* (2013.01); *F24F 3/1429* (2013.01);

(Continued)

(58) Field of Classification Search

CPC ..... F24F 3/1411; F24F 3/1429; F25B 49/02; F25B 2313/006; F25B 2313/02741;

(Continued)

(56) References Cited

U.S. PATENT DOCUMENTS 2,257,478 A * 9/1941 Newton ..... F24F 3/1417 165/222
2,700,537 A * 1/1955 Pennington ..... F24F 3/1423 165/222

(Continued)

FOREIGN PATENT DOCUMENTS

CN 103237589 A 8/2013
JP 2001-173992 A 6/2001

(Continued)

OTHER PUBLICATIONS

International Search Report (PCT/ISA/210) issued on Feb. 1, 2011, by the Japanese Patent Office as the International Searching Authority for International Application No. PCT/JP2010/007430.

(Continued)

*Primary Examiner* — Len Tran
*Assistant Examiner* — Kristin Oswald
(74) *Attorney, Agent, or Firm* — Buchanan Ingersoll & Rooney PC

(57) ABSTRACT

An air-conditioning system includes at least one outdoor unit including a compressor, a four-way valve, and an outdoor heat exchanger, at least one indoor unit including an indoor unit expansion valve and an indoor unit heat exchanger, and at least one humidity control device including a humidity control device expansion valve, a humidity control device heat exchanger, and first and second water adsorption/desorption devices. The compressor, the four-way valve, the outdoor heat exchanger, the indoor unit expansion valve, the indoor unit heat exchanger, the humidity control device expansion valve, and the humidity control device heat exchanger are connected to each other with pipes so as to constitute a refrigerant circuit.

15 Claims, 13 Drawing Sheets

(52) U.S. Cl.
CPC ..... *F25B 2313/006* (2013.01); *F25B 2313/02741* (2013.01); *F25B 2313/0314* (2013.01); *F25B 2313/0315* (2013.01); *F25B 2700/02* (2013.01); *F25B 2700/1931* (2013.01); *F25B 2700/1933* (2013.01)

(58) Field of Classification Search
CPC ..... F25B 13/00; F25B 2313/0315; F25B 2700/02; F25B 2700/1931; F25B 2700/1933; F25B 2313/0314
USPC ..... 62/324.6, 176.2; 236/44 A, 44 C
See application file for complete search history.

(56) References Cited

U.S. PATENT DOCUMENTS 4,173,924 A * 11/1979 Bradshaw ..... B05B 15/1222 118/326
4,646,535 A * 3/1987 Matsuoka ..... B60H 1/321 165/43
4,719,761 A 1/1988 Cromer
4,769,053 A * 9/1988 Fischer, Jr. ..... B01D 53/261 96/125
4,771,707 A * 9/1988 Robson ..... F23G 7/066 110/211
4,841,733 A * 6/1989 Dussault ..... F24F 5/0071 165/223
4,982,575 A * 1/1991 Besik ..... F24F 3/1411 165/4
5,082,173 A * 1/1992 Poehlman ..... F24F 11/0001 165/224
5,230,466 A * 7/1993 Moriya ..... G05D 22/02 236/44 A
5,230,719 A * 7/1993 Berner ..... F24F 3/1411 165/4
5,512,083 A * 4/1996 Dunne ..... B01D 53/06 95/113
5,758,508 A * 6/1998 Belding ..... B01D 53/261 62/271
5,826,443 A * 10/1998 Ares ..... A47F 3/001 165/66
5,879,764 A * 3/1999 Chu ..... B01D 53/28 156/109
5,950,442 A * 9/1999 Maeda ..... F24F 3/1423 62/175
5,975,288 A * 11/1999 Crowder ..... A24F 25/02 206/205
5,975,422 A * 11/1999 Ordberg ..... B60H 1/00071 237/12.3 A
5,983,986 A * 11/1999 Macintyre ..... F24H 3/065 137/311
6,199,388 B1 * 3/2001 Fischer, Jr. ..... F24F 3/1411 62/271
7,437,884 B2 * 10/2008 Otake ..... F24F 3/1423 62/271
2001/0022089 A1 * 9/2001 Wada ..... F24F 11/006 62/126
2004/0129011 A1 * 7/2004 Kikuchi ..... F24F 3/1411 62/271
2004/0177627 A1 * 9/2004 Fujimoto ..... F24F 12/006 62/151
2006/0059928 A1 * 3/2006 Fujiyoshi ..... F24F 11/0015 62/176.6
2007/0180851 A1 * 8/2007 Fujiyoshi ..... F24F 3/1411 62/480
2009/0229294 A1 * 9/2009 Matsui ..... F24F 3/1411 62/271
2013/0239814 A1 9/2013 Ito et al.

FOREIGN PATENT DOCUMENTS

JP 2003-232538 A 8/2003
JP 2005-049059 A 2/2005
JP 2005-283075 A 10/2005
JP 2007-240128 A 9/2007
JP 2010-084970 A 4/2010
JP 2010-107059 A 5/2010
JP 2010-121912 A 6/2010
JP 4513380 B2 7/2010
JP 2010-249485 A 11/2010

OTHER PUBLICATIONS

Office Action (Notice of Reasons for Refusal) issued on Feb. 25, 2014, by the Japanese Patent Office in corresponding Japanese Patent Application No. 2012-549479 and an English translation of the Office Action. (2 pages).
Chinese Office Action dated Feb. 3, 2015 issued in corresponding Chinese Patent Appln. No. 2010800703571, with English translation (19 pages).
Second Office Action dated Sep. 9, 2015 issued in corresponding Chinese Patent Appln. No. 201080070357.7, with English translation (17 pages).
First Office Action dated Nov. 20, 2015 issued in corresponding Chinese Patent Appln. No. 201080070357.7, with English translation (5 pages).

* cited by examiner

AIR-CONDITIONING SYSTEM AND HUMIDITY CONTROL DEVICE

TECHNICAL FIELD

The present invention relates to an air-conditioning system that includes an air-conditioning device configured to perform an indoor temperature control operation (hereinafter referred to as "temperature control") and a humidity control device configured to perform an indoor humidity control operation (hereinafter referred to as "humidity control"), and that is configured to perform an air conditioning operation.

BACKGROUND ART

In an air-conditioning system of the related art, one or more outdoor units and one or more indoor units are connected to each other with pipes so as to constitute a refrigerant circuit in which a refrigerant circulates such that a vapor compression refrigeration cycle is performed.

Indoor air conditioning may be performed by carrying out temperature control or by carrying out humidity control. There has been proposed a system that processes temperature control and humidity control separately so as to increase a refrigerant evaporating temperature in a refrigerant circuit of the temperature control side, and thereby reduce power consumption (see Patent Literature 1, for example).

A humidity control device of this system has a refrigerant circuit, which is provided separately from that of an air-conditioning device, and serves as a ventilation device so as to perform humidity control with a high-efficiency refrigeration cycle using the outdoor air.

CITATION LIST

Patent Literature

Patent Literature 1: Japanese Unexamined Patent Application Publication No. 2010-121912 (claim 1, FIG. 1)

SUMMARY OF INVENTION

Technical Problem

The humidity control device of Patent Literature 1 serves as a ventilation device, and therefore is usually disposed above a ceiling. However, since the ventilation device includes its own refrigerant circuit, the weight of the device is increased.

Moreover, since the humidity control device serves as a ventilation device, the air volume is limited by the ventilation volume when compared with a typical indoor unit. Accordingly, the evaporating temperature needs to be lowered, resulting in increase of power consumption. This leads to reduction in energy efficiency in order to achieve the required dehumidification amount.

The present invention has been made to overcome the above-described problem and an object thereof is to provide an air-conditioning system and the like that is capable of efficiently performing temperature control and humidity control.

Solution to Problem

An air-conditioning system according to the invention includes: at least one outdoor unit including a compressor, a flow switching device, and an outdoor heat exchanger; at least one indoor unit including a first expansion device and a first indoor heat exchanger; and at least one humidity control device including a second expansion device, a second indoor heat exchanger, and first and second water adsorption/desorption devices, in which the compressor, the flow switching device, the outdoor heat exchanger, the first expansion device, the first indoor heat exchanger, the second expansion device, and the second indoor heat exchanger are connected to each other with pipes so as to constitute a refrigerant circuit.

Advantageous Effects of Invention

According to the invention, in the humidity control device, the first and second water adsorption/desorption devices are provided. The second water adsorption/desorption is disposed upstream of the second indoor heat exchanger relative to the flow of air, and humidifies the air so as to increase a dew point temperature of the air that flows into the second indoor heat exchanger, for example. Thus, even if an evaporating temperature of a refrigerant is increased, it is possible to achieve the required dehumidification amount. Accordingly, the amount of dehumidification using, for example, a ventilation device can be reduced, so that it is possible to increase the energy efficiency by reducing power consumption, while maintaining comfort.

DESCRIPTION OF EMBODIMENTS

Embodiment 1

System Configuration

Figure 1:
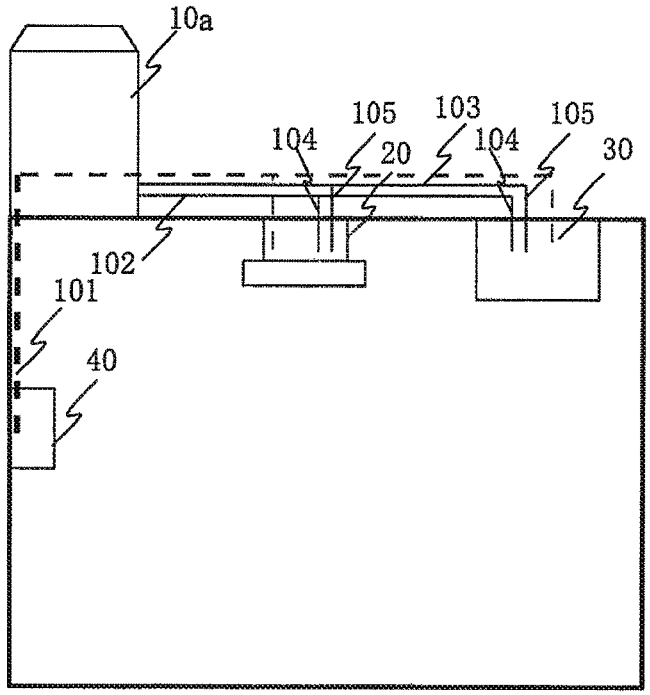
FIG. 1 is a diagram illustrating a configuration of an air-conditioning system according to Embodiment 1 of the invention.

FIG. 1 is a diagram illustrating a configuration of an air-conditioning system according to Embodiment 1 of the invention. The air-conditioning system of Embodiment 1 includes an outdoor unit 10*a*, an indoor unit 20, a humidity control device 30, and a controller 40. The outdoor unit 10*a* is connected to the indoor unit 20 and the humidity control device 30 with a liquid side main pipe 102, liquid side branch pipes 104, a gas side main pipe 103, and gas side branch pipes 105 such that a refrigerant can circulate through the pipes. In addition, the outdoor unit 10*a*, the indoor unit 20, and the humidity control device 30 are connected with a transmission line 101 for communication so as to allow transmission and reception of signals. Further, the outdoor unit 10*a* is also connected to the controller 40 with the transmission line 101. It should be noted that although there is only one of each of the indoor unit 20 and the humidity control device 30 connected to the outdoor unit 10*a* in FIG. 1, there may be more than one of each of these devices. For example, the number of indoor units 20 and the number of humidity control devices 30 to be connected to the outdoor unit 10*a* may be changed in accordance with the outdoor unit capacity, the required humidification amount, and the like (the same applies to the following description).

<<Configuration of Refrigerant Circuit>>

Figure 2:
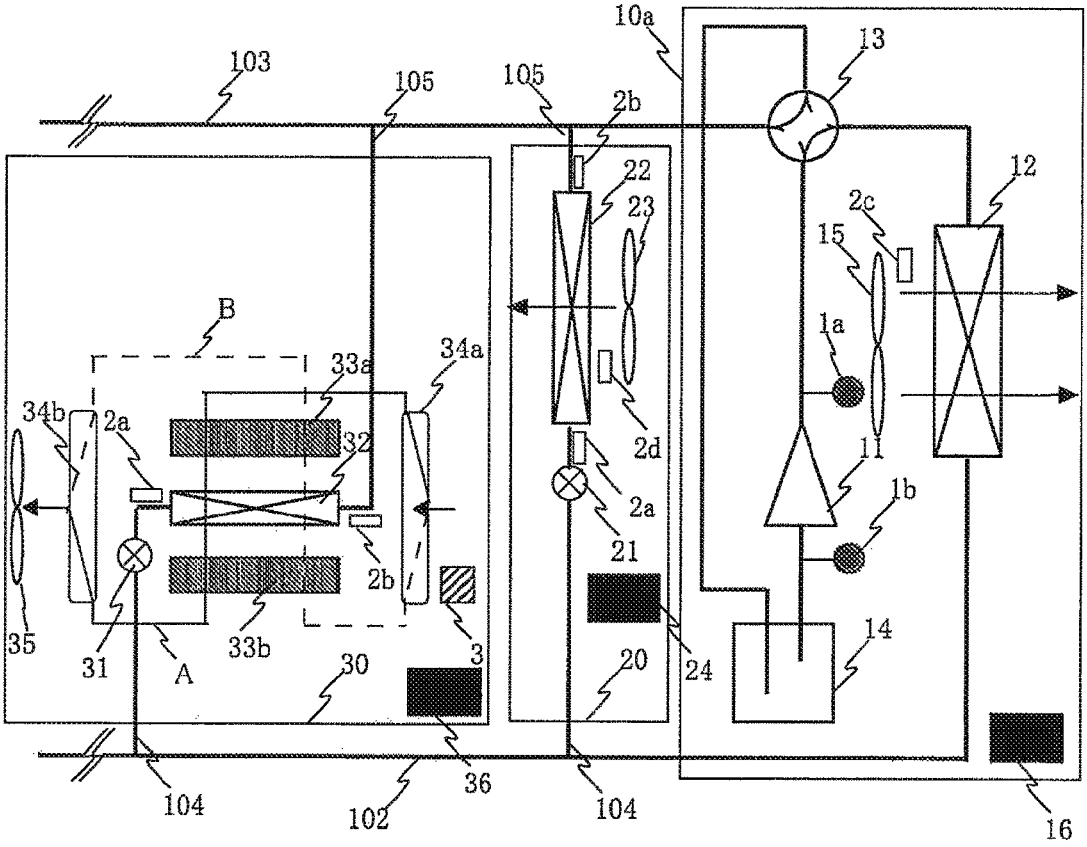
FIG. 2 is a diagram illustrating a configuration of a refrigerant circuit in the system according to Embodiment 1 of the invention.

FIG. 2 is a diagram showing components and the like constituting a refrigerant circuit in the air-conditioning system according to Embodiment 1 of the invention. The outdoor unit 10*a* includes, as components constituting the refrigerant circuit, a compressor 11, an outdoor heat exchanger 12, a four-way valve 13, and an accumulator 14. The compressor 11 of Embodiment 1 is a variable displacement compressor (fluid machinery) that is capable of varying the displacement using an inverter circuit in accordance with an instruction from outdoor unit control means 16. For example, various types of compressors may be used as the compressor 11, such as a reciprocating type, a rotary type, a scroll type, and a screw type. The outdoor heat exchanger 12 exchanges heat between the refrigerant and air (outdoor air). For example, the outdoor heat exchanger 12 serves as an evaporator during a heating operation so as to evaporate and gasify the refrigerant. In addition, the outdoor heat exchanger 12 serves as a condenser during a cooling operation so as to condense and liquefy the refrigerant. The four-way valve 13 serving as a flow switching device switches the flow of the refrigerant between a flow for a cooling operation and a flow for a heating operation in accordance with an instruction from the outdoor unit control means 16. The accumulator 14 is a tank that prevents the refrigerant in the form of a liquid (liquid refrigerant) from passing therethrough and thereby prevents the liquid refrigerant from flowing into the compressor 11.

On the other hand, the outdoor unit 20 includes an indoor unit expansion valve 21 and an indoor unit heat exchanger 22. The indoor unit expansion valve (throttle device, flow control device) 21 serving as a first expansion device adjusts the pressure and the like of the refrigerant by changing the opening degree in accordance with an instruction from indoor unit control means 24. In this embodiment, the valve opening degree can be minutely controlled using a stepping motor. The indoor unit heat exchanger 22 serving as a first indoor heat exchanger exchanges heat between the refrigerant and the air in the room (conditioned area, conditioned space), particularly for the purpose of temperature control. The indoor unit heat exchanger 22 serves as a condenser during a heating operation, and serves as an evaporator during a cooling operation.

The humidity control device 30 includes a humidity control device expansion valve 31 and a humidity control device heat exchanger 32. The humidity control device expansion valve 31 serving as a second expansion device adjusts the pressure of the refrigerant by changing the opening degree in accordance with an instruction from humidity control device control means 36. In this embodiment, the valve opening degree of the indoor unit expansion valve 21 can be minutely controlled. The humidity control device heat exchanger 32 serving as a second indoor heat exchanger exchanges heat between the refrigerant and the air in the room, particularly for the purpose of humidity control. In this embodiment, the humidity control device heat exchanger 32 is designed to serve as an evaporator so as to perform dehumidification during a cooling operation.

The refrigerant used in the refrigerant circuit may include, but is not limited to, natural refrigerants such as carbon dioxide, hydrocarbon, and helium, for example. The refrigerant used herein may further include refrigerants not containing chlorine, such as HFC410A and HFC407C, and fluorocarbon refrigerants that are used in existing products, such as R22 and R134a.

<<Components of System>>

The outdoor unit 10*a* is provided with, in addition to the components constituting the refrigerant circuit, outdoor air-sending means 15 that sends the air to the outdoor heat exchanger 12. The outdoor unit 10*a* is further provided with outdoor unit control means 16 that controls the components of the outdoor unit 10*a* in accordance with a control signal transmitted from the controller 40.

On the other hand, the indoor unit 20 is provided with indoor unit air-sending means 23 that causes the air that has been introduced from the conditioned area to pass through the indoor unit heat exchanger 22 and sends the air to the conditioned area (humidity controlled space). The indoor unit 20 is further provided with indoor unit control means 24 that controls the components of the indoor unit 20 in accordance with a control signal transmitted from the controller 40.

Further, the humidity control device 30 is provided with humidity control device air-sending means 35 that introduces the air from the conditioned area through an air inlet 38, causes the air to pass through an air path in a main body 37, and sends the air into the conditioned area through an air outlet 39. The humidity control device 30 further include two water adsorption/desorption devices (first and second water adsorption/desorption devices) 33*a* and 33*b* that are capable of adsorbing water from the air passing therethrough and desorbing (releasing) water into the air passing therethrough. The humidity control device 30 further includes air flow switching means 34*a* and 34*b* that perform switching between air channels in the air path. The air flow switching means 34*a* on an upstream side close to the air inlet 38 is a first branch part, and the air flow switching means 34*b* on a downstream side close to the air outlet 39 is a second branch part. The humidity control device 30 is further provided with humidity control device control means 36 that controls the components of the humidity control device 30 in accordance with a control signal transmitted from the controller 40. As can be seen from the above, the humidity control device 30 is constituted by including the main body 37, the water adsorption/desorption devices 33*a* and 33*b*, and the air flow switching means 34*a* and 34*b*, in addition to the components corresponding to those of the indoor unit 20. The configuration and the operations of the humidity control device 30 will be described below in greater detail.

In Embodiment 1, the outdoor air-sending means 15, the indoor unit air-sending means 23, and the humidity control device air-sending means 35 are configured such that the air volume can be adjusted and controlled, and such that the air volume can be set in accordance with the air conditions, for example. In the case where a DC motor is used as a motor for rotating the fan, the air volume can be controlled by controlling the rotation speed. On the other hand, in the case where an AC motor is used, the air volume can be controlled by changing the power supply frequency using inverter control and thereby changing the rotation speed.

<<Sensor Arrangement in System>>

A discharge pressure sensor 1*a* is provided on a discharge side of the compressor 11. Further, a suction pressure sensor 1*b* is provided on a suction side. On the other hand, a liquid pipe temperature sensor 2*a* and a gas pipe temperature sensor 2*b* are provided in each of the indoor unit 20 and the humidity control device 30. Further, an outdoor air temperature sensor 2*c* is provided on an air inflow side of the outdoor heat exchanger 12. An inlet air temperature sensor 2*d* is provided on an air inlet side of the indoor unit heat exchanger 22 of the indoor unit 20. Further, a temperature/humidity sensor 3 is provided on an air inlet 38 side of the humidity control device 30 (described below).

<<Refrigeration Cycle Operation>>

[Cooling Operation]

Next, a description will be given of a flow of the refrigerant in the refrigerant circuit during a cooling operation with reference to FIG. 2. The refrigerant that has been discharged from the compressor 11 of the outdoor unit 10*a* flows into the outdoor heat exchanger 12 via the four-way valve 13. The refrigerant is condensed and liquefied in the outdoor heat exchanger 12 through heat exchange with the air, and flows out of the outdoor unit 10*a*. The refrigerant that has flowed out therefrom flows through the liquid side main pipe 102, and is branched into the liquid side branch pipes 104 so as to flow into the indoor unit 20 and the humidity control device 30. The refrigerants that have flowed into the indoor unit 20 and the humidity control device 30 are subjected to pressure reduction in the indoor unit expansion valve 21 and the humidity control device expansion valve 32, respectively, and then flow into the indoor unit heat exchanger 22 and the humidity control device heat exchanger 32, respectively. The refrigerants are evaporated and gasified through heat exchange with the air in the indoor unit heat exchanger 22 and the humidity control device heat exchanger 32, respectively, and flow out of the indoor unit 20 and the humidity control device 30, respectively. The refrigerants that have flowed out therefrom flow through the gas side branch pipes 105 and the gas side main pipe 103, and flow into the outdoor unit 10*a*. The refrigerant that has flowed therein passes through the four-way valve 13 and the accumulator 14, and is suctioned again by the compressor 11.

[Heating Operation]

Further, a description will be given of a flow of the refrigerant in the refrigerant circuit during a heating operation with reference to FIG. 2. In this embodiment, the flow for a heating operation is switched from the flow for a cooling operation by switching the four-way valve 13. The refrigerant that has been discharged from the compressor 11 flows out of the outdoor unit 10*a* through the four-way valve 13. The refrigerant that has flowed out therefrom flows through the gas side main pipe 103, and is branched into the gas side branch pipes 105 so as to flow into the indoor unit 20 and the humidity control device 30. The refrigerants that have flowed into the indoor unit 20 and the humidity control device 30 flow into the indoor unit heat exchanger 22 and the humidity control device heat exchanger 32, respectively. The refrigerants are condensed and liquefied through heat exchange with the air in the indoor unit heat exchanger 22 and the humidity control device heat exchanger 32. Then, the refrigerants are subjected to pressure reduction at the indoor unit expansion valve 21 and the humidity control device expansion valve 31, respectively, and then flow out of the indoor unit 20 and the humidity control device 30, respectively. The refrigerants that have flowed out from the indoor unit 20 and the humidity control device 30 flow through the liquid side branch pipes 104 and the liquid side main pipe 102, and flow into the outdoor unit 10*a*. The refrigerant that has flowed therein flows into the outdoor heat exchanger 12. In the heat exchanger 12, the refrigerant is evaporated and gasified through heat exchange with the air. Then, the refrigerant passes through the four-way valve 13 and the accumulator 14, and is suctioned again by the compressor 11.

<<Dehumidification Operation of Dehumidification Device 30>>

Figure 3:
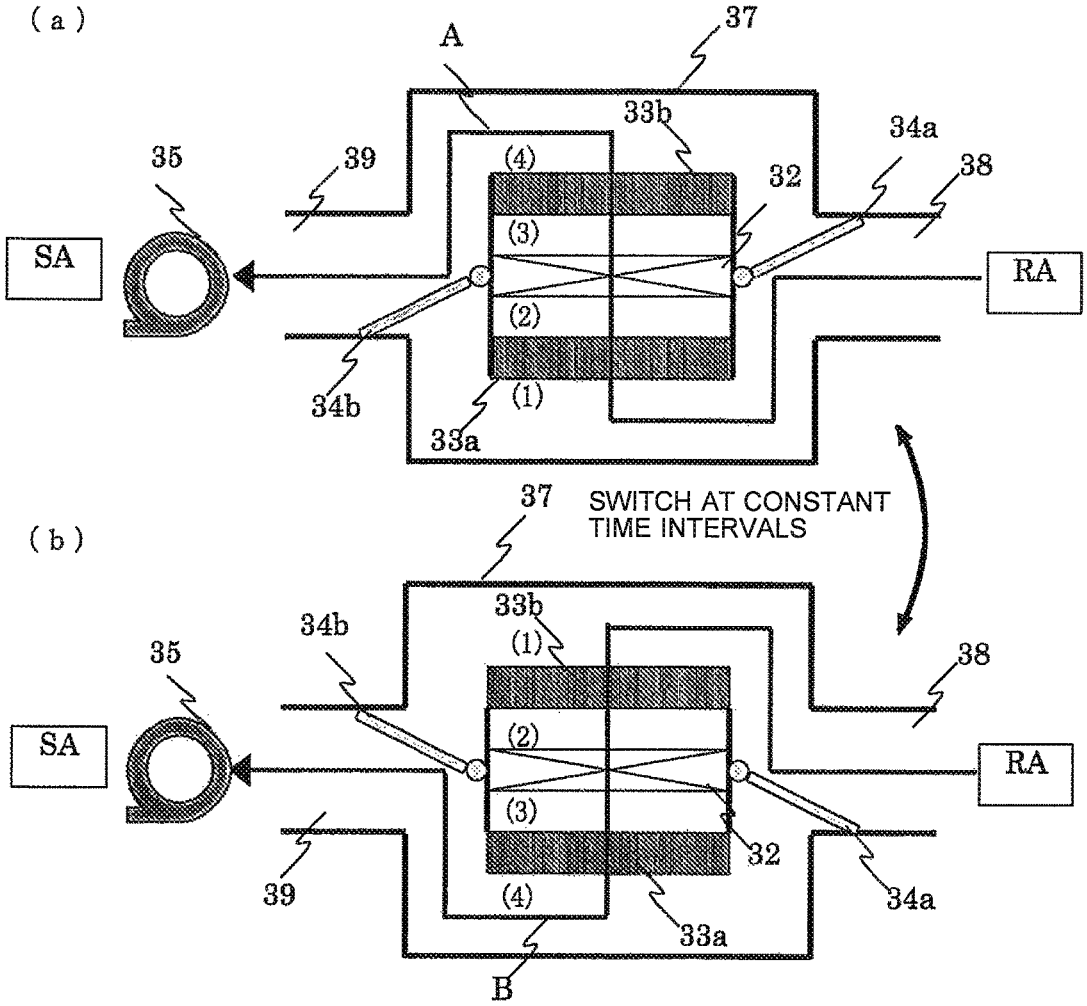
FIGS. 3*a* and 3*b* are diagrams illustrating a configuration of a humidity control device 30 according to Embodiment 1 of the invention.

FIG. 3 is a diagram illustrating operations of the humidity control device 30 according to Embodiment 1. The following describes a dehumidification operation performed by the humidity control device 30. In the following, a case in which a cooling operation is performed by the air-conditioning system will be described.

First, a description will be given of an operation in an air channel A with reference to FIG. 3(*a*). The air channel A is a channel in which the air passes through the water adsorption/desorption device 33*a*, the humidity control device heat exchanger 32, and the water adsorption/desorption device 33*b* in this order. The air channel can be switched by operating the air flow switching means 34*a* and 34*b*, which may be formed of a damper, for example. Further, the switching time can be controlled by controlling rotation operations of a motor or the like that is used for switching the channels. The air channel switching means 34*a* is disposed upstream of the water adsorption/desorption devices 33*a* and 33*b* and the humidity control device heat exchanger 32 relative to the flow of the air. On the other hand, the air channel switching means 34*b* is disposed downstream of the water adsorption/desorption devices 33*a* and 33*b* and the humidity control device heat exchanger 32 relative to the flow of the air.

When the humidity control device air-sending means 35 is driven, return air RA is suctioned (introduced) from the air inlet 38, and passes through the water adsorption/desorption device 33*a* in the main body 37. At this point, the adsorbent of the water adsorption/desorption device 33*a* releases water into the air through a desorption reaction, and humidifies the air passing therethrough. The air that has passed through the water adsorption/desorption device 33*a* passes through the humidity control device heat exchanger 32. At this point, the humidity control device heat exchanger 32 serving as an evaporator cools the air to its dew point temperature or below so as to dehumidify the air. The air that has passed through the humidity control device heat exchanger 32 passes through the water adsorption/desorption device 33*b*.

In the water adsorption/desorption device 33*b*, the adsorbent further adsorbs water from the air so as to dehumidify the air. The air that has passed through the water adsorption/desorption device 33*b* passes through the humidity control device air-sending means 35, flows out from the air outlet 39, and is supplied as supply air SA into the room (conditioned space).

Next, a description will be given of an operation in an air channel B with reference to FIG. 3(*b*). The air channel B is a channel in which the air passes through the water adsorption/desorption device 33*b*, the humidity control device heat exchanger 32, and the water adsorption/desorption device 33*a* in this order.

When the humidity control device air-sending means 35 is driven, a return air RA is suctioned from the air inlet 38 and passes through the water adsorption/desorption device 33*b*. At this point, the adsorbent of the water adsorption/desorption device 33*b* releases water into the air through a desorption reaction, and humidifies the air passing therethrough. The air that has passed through the water adsorption/desorption device 33*b* passes through the humidity control device heat exchanger 32. At this point, the humidity control device heat exchanger 32 serving as an evaporator cools the air to its dew point temperature or below so as to dehumidify the air. The air that has passed through the humidity control device heat exchanger 32 passes through the water adsorption/desorption device 33*a*. In the water adsorption/desorption device 33*a*, the adsorbent further adsorbs water from the air so as to dehumidify the air. The air that has passed through the water adsorption/desorption device 33*a* passes through the humidity control device air-sending means 35, flows out from the air outlet 39, and is supplied as supply air SA into the room.

It is to be noted that each of the water adsorption/desorption device 33*a* and 33*b* of Embodiment 1 is a polygonal porous plate having a shape corresponding to a cross sectional shape of the air path so as to have a greater ventilation cross sectional area with respect to a cross sectional area of the air path of the device, and is configured such that the air passes therethrough in a thickness direction thereof. Further, the porous plate used herein is prepared by applying to the surface thereof an adsorbent, such as zeolite, silica gel, and activate carbon, that has a characteristic of adsorbing water from the air with a relatively high humidity and releasing water into the air with a relatively low humidity, and then being subjected to a surface finishing treatment and impregnation. Although the water adsorption/desorption devices 33*a* and 33*b* described herein have a quadrangular shape (rectangle, square), the shape is not limited thereto as long as the same effects can be attained.

Figure 4:
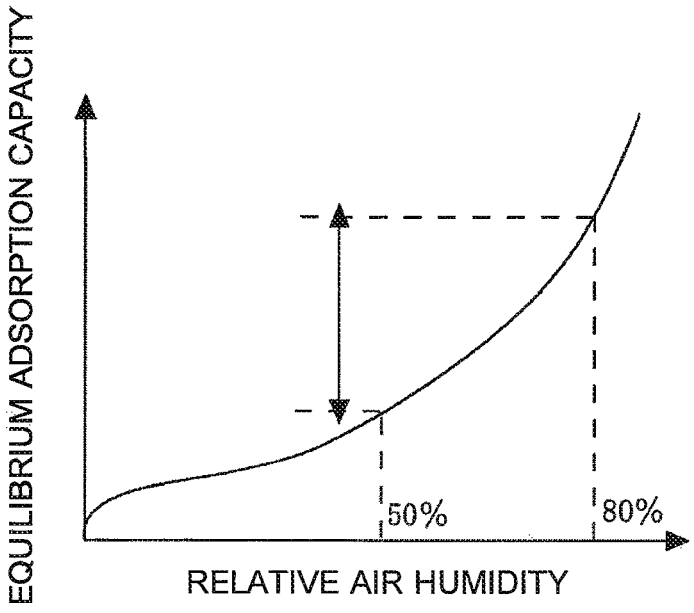
FIG. 4 is a chart showing a relationship between the relative humidity of air and the equilibrium adsorption capacity according to Embodiment 1.

FIG. 4 is a chart showing a relationship between the relative air humidity of the air and the equilibrium adsorption capacity. In FIG. 4, the amount of water (equilibrium adsorption capacity) which the adsorbent used in the water adsorption/desorption devices 33*a* and 33*b* can adsorb with respect to the relative air humidity is shown. Usually, the equilibrium adsorption capacity increases as the relative air humidity increases. With respect to the adsorbent used in this embodiment, as mentioned above, use of an adsorbent having a great difference between the equilibrium adsorption capacity at a relative air humidity of 80% or greater and the equilibrium adsorption capacity at a relative air humidity in a range of 40%-60% makes it possible to increase the water adsorption/desorption capacity of the water adsorption/desorption devices 33*a* and 33*b*.

Further, if the air volume of the humidity control device air-sending means 35 varies, the flow velocity of the air passing through the water adsorption/desorption devices 33*a* and 33*b* also varies. Since the transfer rate of the water between the air and the adsorbent upon adsorption/desorption by the water adsorption/desorption devices 33*a* and 33*b* increases as the air flow velocity increases, the humidification/dehumidification capacity can be increased.

The humidity control device air-sending means 35 is disposed on the most downstream side (the air outlet 39 side) in FIG. 3, the humidity control device air-sending means 35 may be disposed on the most upstream side (the air inlet 38 side) as long as the target air volume can be obtained in the two air channels. Further, a plurality of humidity control device air-sending means 35 may be disposed on the upstream side and downstream side. As described herein, the arrangement position and the number of the humidity control device air-sending means 35 are not limited to those of this embodiment.

Figure 5:
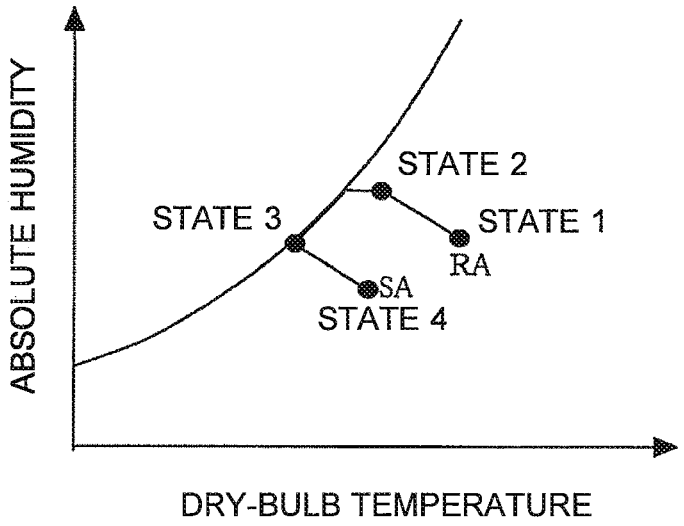
FIG. 5 is a psychrometric chart illustrating a dehumidifying operation according to Embodiment 1.
Figure 6:
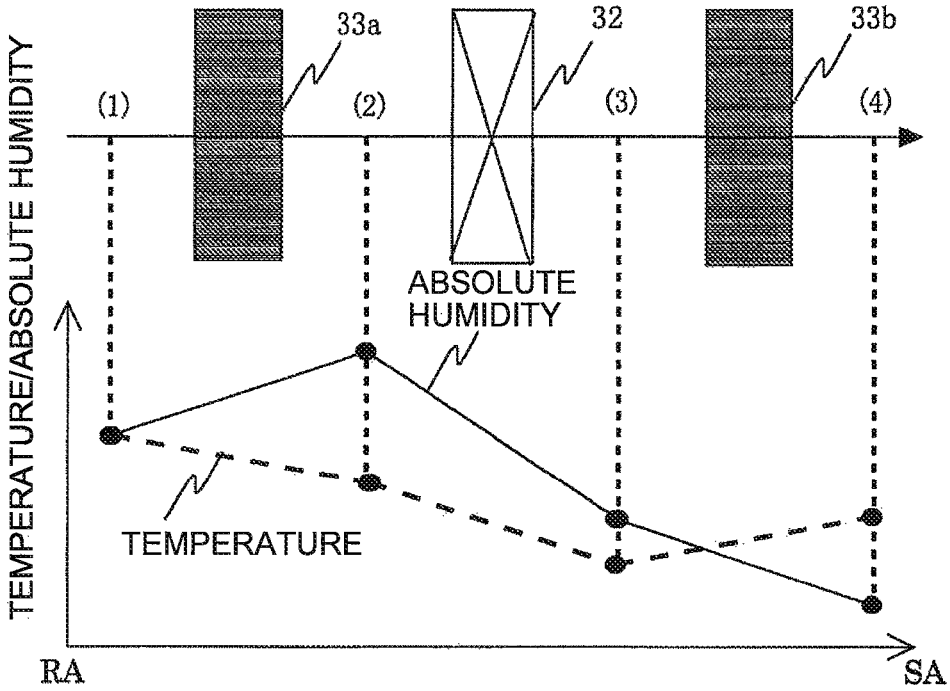
FIG. 6 is a chart showing the temperature and the absolute humidity during the dehumidifying operation according to Embodiment 1.

FIG. 5 is a psychrometric chart illustrating a change in the state of the air during a dehumidification operation of the humidity control device 30. It is to be noted that States 1 through 4 representing the air states in FIG. 5 correspond to the air states at positions (1) through (4), respectively, in FIG. 3. Further, FIG. 6 is a chart showing the temperature and the absolute humidity of the passing air in each of the states at predetermined positions in the humidity control device 30. It is to be noted that FIG. 6 shows the changes in the case of the air channel A. In the case of the air channel B, the positional relationship between the water adsorption/desorption device 33*a* and the position of the water adsorption/desorption device 33*b* is reversed.

<<Description of State of Air>>

(Air Channel A)

Next, the air state during a dehumidification operation will be described in detail with reference to FIGS. 4 through 6. The above-described air channel A in the humidity control device 30, the return air RA (State 1) passes through the water adsorption/desorption device 33*a*. In many cases, the return air RA that has been introduced from the room has a relative humidity in a range of 40%-60% due to the indoor environment. As described above, since the water adsorption/desorption device 33*a* releases water through a desorption reaction of the adsorbent in accordance with the water content, the air is humidified (the air becomes humidified air) (State 2). At this point, the humidified air has a lower temperature than and a higher relative humidity than the introduced air (the air in State 1). Further, since the absolute humidity is increased, the dew point temperature is increased, and therefore the air will be condensed more easily.

When the humidified air passes through the humidity control device heat exchanger 32 and is cooled to the dew temperature or below, the humidified air is dehumidified (the humidified air becomes dehumidified air) (State 3). At this point, the relative humidity of the dehumidified air is as high as about 70%-90%. Therefore, the adsorbent of the water adsorption/desorption device 33*b* can adsorb water more easily. Then, the dehumidified air passes through the water adsorption/desorption device 33*b*. At this point, water is adsorbed through an adsorption reaction in the adsorbent of the water adsorption/desorption device 33*b*, so that the air is further dehumidified. The dehumidified air is supplied into the room as supply air SA (State 4).

(Air Channel B)

Next, a description will be given of the air channel B. In the air channel B, the return air RA (State 1) passes through the water adsorption/desorption device 33*b*. In many cases, the return air RA that has been introduced from the room has a relative humidity in a range of 40%-60% due to the indoor environment. As described above, since the water adsorption/desorption device 33*b* releases water through a desorption reaction of the adsorbent in accordance with the water content, the air is humidified (the air becomes humidified air) (State 2). At this point, the humidified air has a lower temperature than and a higher relative humidity than the introduced air (the air in State 1). Further, since the absolute humidity is increased, the dew point temperature is increased, and therefore the air will be condensed more easily.

When the humidified air passes through the humidity control device heat exchanger 32 and is cooled to the dew temperature or below, the humidified air is dehumidified (the humidified air becomes dehumidified air) (State 3). At this point, the relative humidity of the dehumidified air is as high as about 70%-90%. Therefore, the adsorbent of the water adsorption/desorption device 33*a* can adsorb water more easily. Then, the dehumidified air passes through the water adsorption/desorption device 33*a*. At this point, water is adsorbed through an adsorption reaction in the adsorbent of the water adsorption/desorption device 33*a*, so that the air is further dehumidified. The dehumidified air is supplied into the room as supply air SA (State 4).

Then, the air channel switching means 34*a* and 34*b* are operated so as to perform switching between the air channels A and B. Thus, the adsorbent of the water adsorption/desorption device 33*b* which performed an adsorption reaction in the channel A will perform a desorption operation in the channel B. Conversely, the adsorbent of the water adsorption/desorption device 33*a* which performed a desorption reaction in the channel A will perform an adsorption operation in the channel B. Accordingly, the adsorbents can continuously perform a dehumidification operation without reaching a state of equilibrium.

Figure 7:
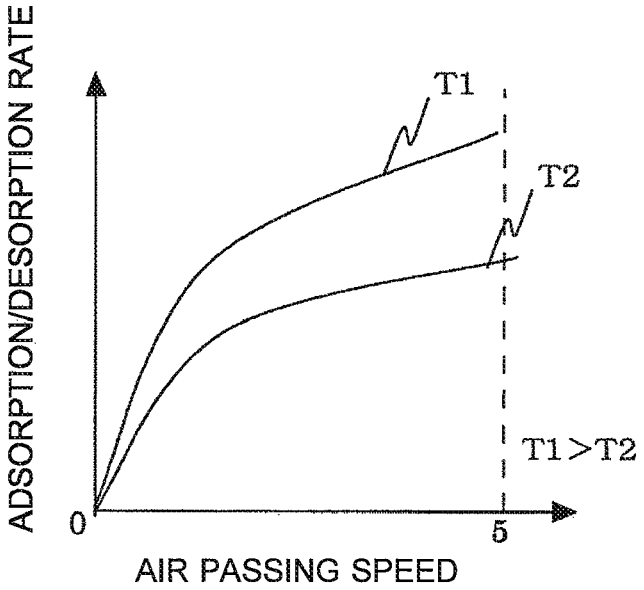
FIG. 7 is a chart showing a relationship between the air velocity and the water adsorption/desorption speed of an adsorbent according to Embodiment 1.

FIG. 7 is a chart showing a relationship between the velocity of the air passing through the water adsorption/desorption devices 33*a* and 33*b* (the air passing velocity) and the adsorption/desorption speed. The adsorption/desorption speed of the adsorbents used in the water adsorption/desorption devices 33*a* and 33*b* varies in accordance with the air velocity (i.e., is dependent on the air velocity). The humidity control device air-sending means 35 controls and varies the air volume so as to increase the adsorption/desorption capacity of the water adsorption/desorption devices 33*a* and 33*b*. Further, as shown in FIG. 7, the adsorption/desorption speed is also dependent on the temperature. The higher the temperature is, the higher the adsorption/desorption speed becomes.

<<System Control Method>>

Figure 8:
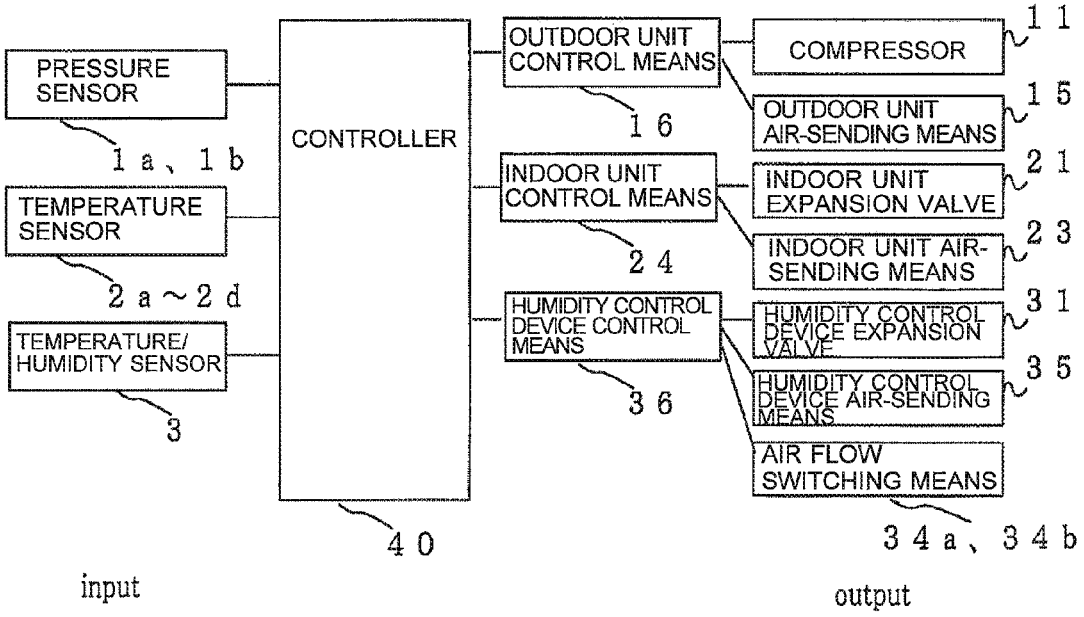
FIG. 8 is a diagram illustrating a control relationship in the air-conditioning system according to Embodiment 1 of the invention.

FIG. 8 is a diagram showing a control relationship in the air-conditioning system. In Embodiment 1, a controller 40 having means for inputting an operation instruction issued by a user controls the entire system. The pressure sensors 1*a* and 1*b* (the discharge pressure sensor 1*a* and the suction pressure sensor 1*b*), the temperature sensors 2*a*-2*d* (the liquid pipe temperature sensor 2*a*, the gas pipe temperature sensor 2*b*, the outdoor air temperature sensor 2*c*, and the inlet air temperature sensor 2*d*), and the temperature/humidity sensor 3 transmit signals indicating pressures, temperatures, and humidity that they have detected to the controller 40. The controller 40 transmits a control signal to the outdoor unit control means 16, the indoor unit control means 24, and the humidity control device control means 36 based on these pressures, temperatures, and humidity. The operations of the compressor 11, the indoor unit expansion valve 21, the humidity control device expansion valve 31, the outdoor air-sending means 15, the indoor air-sending means 23, the humidity control device air-sending means 35, the air flow switching means 34*a* and 34*b*, etc., can be controlled based on this control signal.

Advantages of Embodiment 1

Figure 9:
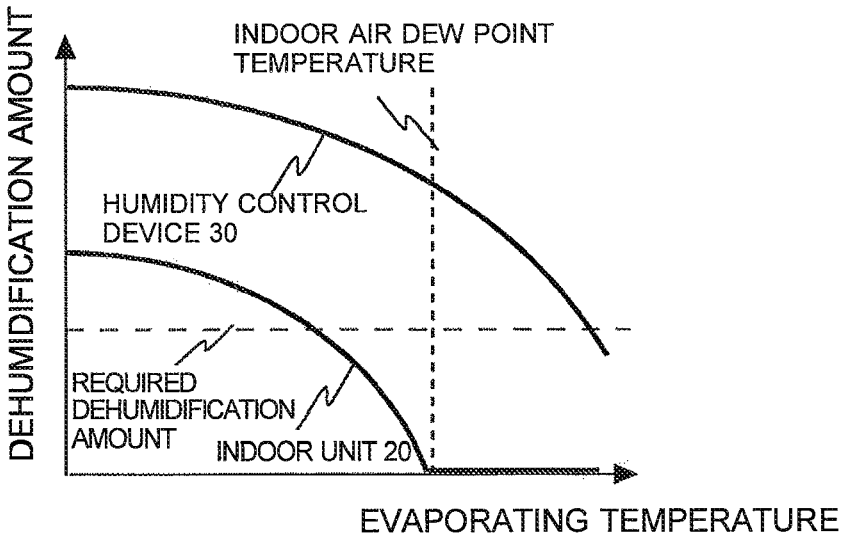
FIG. 9 is a chart showing a relationship between the evaporating temperature and the dehumidification amount of each of an indoor unit 20 and a humidity control device 30.

FIG. 9 is a chart showing a relationship between the evaporating temperature of the refrigerant and the dehumidification amount of each of the indoor unit 20 and the humidity control device 30. As mentioned above, in the air-conditioning system of Embodiment 1, during a cooling operation, the air is humidified by the water adsorption/desorption device 33*a* or 33*b*, and then the humidified air passes through the humidity control device heat exchanger 32. Accordingly, the dew point temperature of the humidified air is increased. Therefore, as shown in FIG. 9, it is possible to achieve the required dehumidification amount even when the evaporating temperature of the refrigerant is increased.

Figure 10:
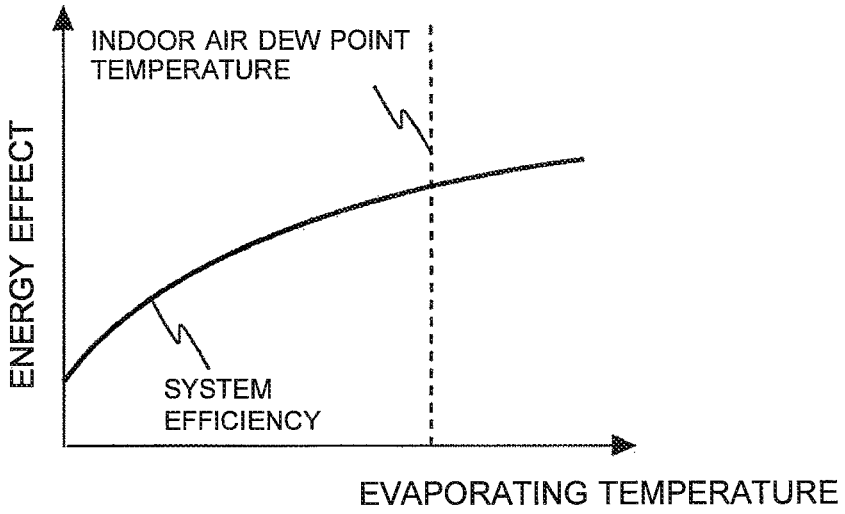
FIG. 10 is a chart showing a relationship of the evaporating temperature and the energy efficiency of the air-conditioning system.

FIG. 10 is a chart showing a relationship between the evaporating temperature of the refrigerant and the energy efficiency. As shown in FIG. 10, the system efficiency increases as the evaporating temperature of the refrigerant increases. As mentioned above, since the air-conditioning system of Embodiment 1 can increase the evaporating temperatures of the refrigerants of the indoor unit 20 and the humidity control device 30, the system efficiency can be increased. This makes it possible to reduce the power consumption.

Further, since the refrigerant circuit is formed by connecting the indoor unit 10*a*, the outdoor unit 20, and the humidity control device 30 to one another through pipes, there is no need to form an independent refrigerant circuit for humidity control by providing a compressor, for example. This makes it possible to reduce the weight of the entire system.

Further, since the humidity control device 30 does not have a desorption heat source, it is possible to use the same pipe connection as in the case of indoor units of the related-art. Accordingly, it is easy to replace an air-conditioning system of the related art.

Further, the water adsorption/desorption devices 33*a* and 33*b* and the humidity control device heat exchanger 32 are arranged substantially in series in the direction in which the air flows in both the air channels A and B, and the humidity control device heat exchanger 32 is disposed between the water adsorption/desorption device 33*a* and the water adsorption/desorption device 33*b*. The water adsorption/desorption devices 33*a* and 33*b* and the humidity control device heat exchanger 32 can be stored in a small space in the main body 37 by arranging these devices such that the surfaces of the water adsorption/desorption devices 33*a* and 33*b* through which the air passes face the surfaces of the humidity control device heat exchanger 32 through which the air passes, respectively. This makes it possible to reduce the size of the dehumidification device 30. With regard to the expression "facing" as used herein, the water adsorption/desorption devices 33*a* and 33*b* and the humidity control device heat exchanger 32 may not be accurately parallel to each other and may be slightly displaced in angle as long as the same advantages can be achieved.

In the case where a plurality of indoor units 20 are connected to the outdoor unit 10*a*, the dehumidification capacity can be changed in accordance with the environment by changing the balance between the installation number of the indoor units 20 and the humidity control devices 30.

Further, since the water adsorption/desorption devices 33*a* and 33*b* using the adsorbents that have high equilibrium adsorption capacity at a high humidity range as shown in FIG. 4 are used, desorption can be performed utilizing only the difference between the water content of the water adsorption/desorption devices 33*a* and 33*b* and the equilibrium adsorption capacity which is dependent on the relative air humidity. Therefore, there is no need to provide any heating means. Accordingly, the size of the device can be reduced.

In this case, if an adsorbent having a high equilibrium adsorption capacity particularly at a relative air humidity of 80% or higher is used, as mentioned above, humidification of the air can be performed without providing any special heating means that serves as the desorption heat source. This eliminates the need for processing the heat amount using heating means. Thus, the humidity control device heat exchanger 32 only performs heat treatment on the return air RA, so that energy savings can be achieved.

Further, as shown in FIG. 7, since the adsorption/desorption speed of the adsorbents of the water adsorption/desorption devices 33*a* and 33*b* are dependent not only on the air velocity but also on the temperature, the adsorption/desorption speed increases as the temperature increases. Therefore, in the case where there is a great difference between the temperature of the air upon desorption and the temperature of the air upon adsorption, there is a great difference between the adsorption and desorption speeds. However, the total amounts of water movement upon adsorption and desorption are balanced in accordance with one of the adsorption speed and the desorption speed having a lower rate. Since there is no need to provide heating means that serves as the desorption heat source in the dehumidification device 30 of the system of Embodiment 1, the difference between the temperature of the air upon adsorption and the temperature of the air upon desorption is smaller compared to the case where heating means is provided, and therefore the difference between the adsorption and desorption speeds is reduced. Accordingly, the adsorption speed and the desorption speed become close to equal to each other, which makes it possible to use the potential of the adsorbent with high efficiency.

Further, since heating means that serves as the desorption heat source is not provided, the temperature difference between the water adsorption/desorption devices 33*a* and 33*b* is reduced even when the air channels are switched. Further, since the temperature difference with the passing air is reduced, the thermal resistance of the adsorbent generated due to the temperature difference between the adsorbents of the water adsorption/desorption devices 33*a* and 33*b* and the passing air is reduced. This makes it possible to perform dehumidification with high efficiency.

Further, the water adsorption/desorption devices 33*a* and 33*b* are fixed in the air path, and remain stationary without making any movement. Therefore, unlike a desiccant rotor that makes a rotational movement, the shapes of the water adsorption/desorption devices 33*a* and 33*b* are not limited. Accordingly, the ventilation areas of the water adsorption/desorption devices 33*a* and 33*b* can be formed to match the shape of the air path. Further, the pressure loss can be reduced by increasing the ventilation area and thereby reducing the air velocity. Also, the adsorption/desorption amount can be increased by increasing the contact area between the adsorbents of the water adsorption/desorption devices 33*a* and 33*b* and the air.

Further, in the water adsorption/desorption devices 33*a* and 33*b*, the air inflow direction during an adsorption operation is opposite to that during a desorption operation, and the ventilation direction is reversed upon switching between adsorption and desorption operations. Accordingly, the humidification/dehumidification efficiency can be increased.

Embodiment 2

Figure 11:
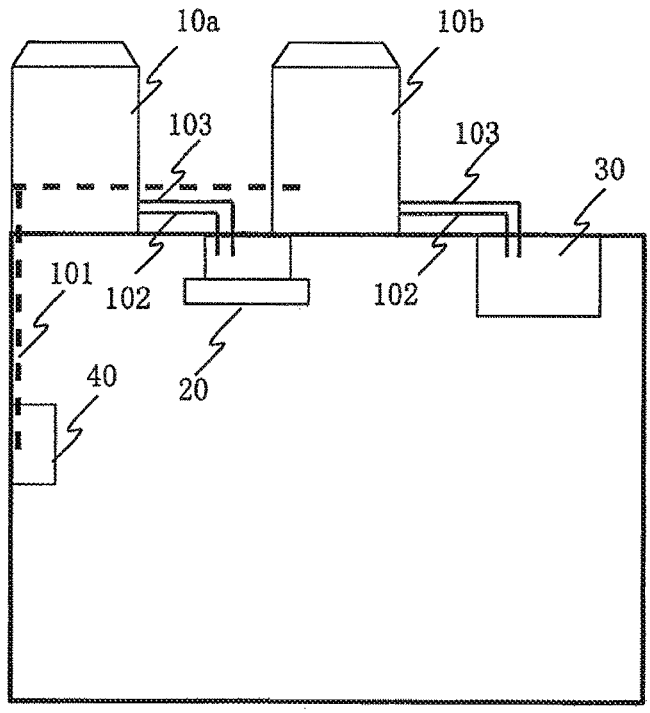
FIG. 11 is a diagram illustrating a configuration of an air-conditioning system according to Embodiment 2 of the invention.

FIG. 11 is a diagram illustrating a configuration of an air-conditioning system according to Embodiment 2 of the invention. In this embodiment, an outdoor unit 10*a* and an indoor unit 20 are connected to each other with a liquid main pipe 102 and a gas main pipe 103 so as to constitute a refrigerant circuit. Similarly, an outdoor unit 10*b* and a humidity control device 30 are connected to each other with pipes so as to constitute another refrigerant circuit.

In this embodiment, the outdoor unit 10*a*, the outdoor unit 10*b*, the indoor unit 20, the humidity control device 30, and a controller 40 are connected to each other with a transmission line 101 for communication, and can be controlled cooperatively as a system. Operations such as controlling dehumidification and the evaporating temperature of the refrigerant in the indoor unit 20 and the humidity control device 30 are the same as those described in Embodiment 1.

Advantages of Embodiment 2

As described above, in the air-conditioning system of Embodiment 2, the humidity control device 30 and the indoor unit 20 are separately connected to the outdoor units 10*a* and 10*b*, respectively. Therefore, the evaporating temperature of the refrigerant on the humidity control device 30 side and the evaporating temperature of the refrigerant on the indoor unit side can be changed and thus the evaporating temperature of the refrigerant can be set only for the purpose of temperature control in the indoor unit 20. Accordingly, the evaporating temperature can be further increased in the indoor unit 20, and the efficiency can be increased.

Embodiment 3

Figure 12:
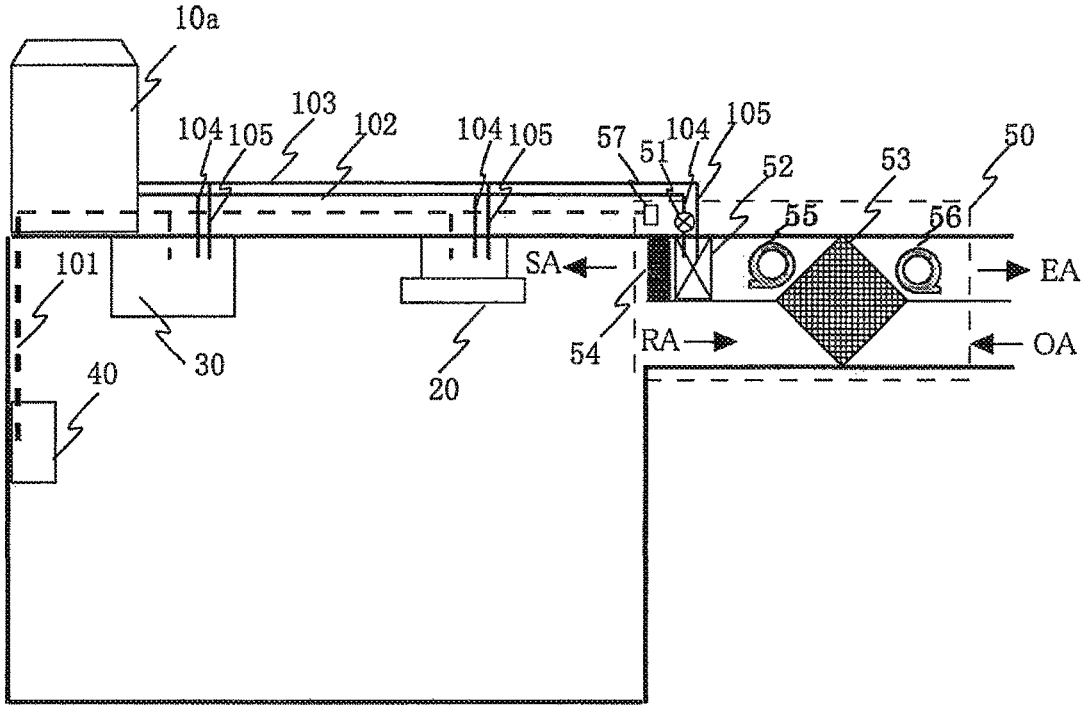
FIG. 12 is a diagram illustrating a configuration of an air-conditioning system according to Embodiment 3 of the invention.

FIG. 12 is a diagram illustrating a configuration of an air-conditioning system according to Embodiment 3 of the invention. The air-conditioning system of Embodiment 3 further includes an outdoor air treatment device 50. An outdoor unit 10*a* is connected to an indoor unit 20, a humidity control device 30, and the outdoor air treatment device 50 with a liquid main pipe 102, liquid branch pipes 104, a gas main pipe 103, and gas branch pipes 105 such that a refrigerant can circulate therethrough, and thus a refrigerant circuit is formed. In addition, they, including the outdoor air treatment device 50, are connected to each other with a transmission line 101 for communication so as to allow transmission and reception of signals.

The outdoor air treatment device 50 includes an outdoor air treatment device expansion valve (third expansion device) 51, an outdoor air treatment device heat exchanger (third indoor heat exchanger) 52, a total heat exchanger 53, humidifying means 54, supply air sending means 55, exhaust air sending means 56, and outdoor air treatment device control means 57.

Similar to the indoor unit expansion valve 21, the outdoor air treatment device expansion valve 51 is configured such that the valve opening degree thereof can be minutely controlled using a stepping motor, for example. The outdoor air treatment device heat exchanger 52 exchange heat between a refrigerant and outdoor air OA. The total heat exchanger 53 performs total heat exchange between the outdoor air OA and return air RA. The humidifying means 54 is configured to humidify the air that has passed through the outdoor air treatment device heat exchanger 52 and sends the humidified air into the room as supply air SA.

The supply air sending means 55 is configured to form a flow of air by causing the outdoor air OA to pass through the total heat exchanger 53, the outdoor air treatment device heat exchanger 52, and the humidifying means 54 and to be supplied into the room as supply air SA. The exhaust air sending means 56 is configured to form a flow of air by causing the return air RA to pass through the total heat exchanger 53 and to be exhausted out of the room as exhaust air EA. The outdoor air treatment device control means 57 controls components of the outdoor air treatment device 50 in accordance with the control signal transmitted from the controller 40.

In this embodiment, the outdoor air OA passes through the total heat exchanger 53, the outdoor air treatment device indoor heat exchanger 52, and the humidifying means 54 in this order in the outdoor air treatment device 50, and is supplied into the room as supply air SA.

On the other hand, the return air RA passes through the total heat exchanger 53 in the outdoor air treatment device 50, and is exhausted out of the room as exhaust air EA.

Temperature control and humidity control operations of the outdoor unit 10*a*, the indoor unit 20, and the humidity control device 30 are the same as those described in Embodiment 1.

Advantages of Embodiment 3

As described above, the air-conditioning system of Embodiment 3 includes the outdoor air treatment device 50, and can perform a total heat exchange between the outdoor air OA and the return air RA using the total heat exchanger 53. Therefore, a workload to be generated by ventilation can be reduced, so that it is possible to reduce operations of driving the compressor 11.

Further, in the case where the outdoor air has a higher temperature and a higher humidity than the indoor air (assuming that the outdoor unit 10*a* performs a cooling operation), the outdoor air that has passed through the total heat exchanger 53 has a higher temperature and a higher humidity than the indoor air. Accordingly, the difference of the evaporating temperature of the refrigerant flowing through the outdoor air treatment device heat exchanger 52 from the temperature of the passing air is greater than the difference from the indoor air. Therefore, it is possible to perform heat treatment with higher efficiency.

Further, in the case where the outdoor air has a lower temperature and a lower humidity than the indoor air (assuming that the outdoor unit 10*a* performs a heating operation), the outdoor air that has passed through the total heat exchanger 53 has a lower temperature and a lower humidity than the indoor air. Accordingly, the difference of the condensing temperature of the refrigerant flowing through the outdoor air treatment device heat exchanger 52 from the temperature of the passing air is greater than the difference from the indoor air. Therefore, it is possible to perform heat treatment with higher efficiency.

In the case of performing a heating and humidification operation during winter, it is possible to humidify the room with use of the humidifying means 54. The humidifying means 54 can humidify the passing air using a water supply type moisture permeable film, an ultrasonic humidifier, or the like.

Since the outdoor air treatment device 50 is not provided with a compressor 11, all of the indoor unit 20, the humidity control device 30, and a device disposed above the ceiling in a position corresponding to the position of the outdoor air treatment device 50 do not need to be provide with a compressor 11, which makes it possible to reduce the size and weight.

Embodiment 4

Figure 13:
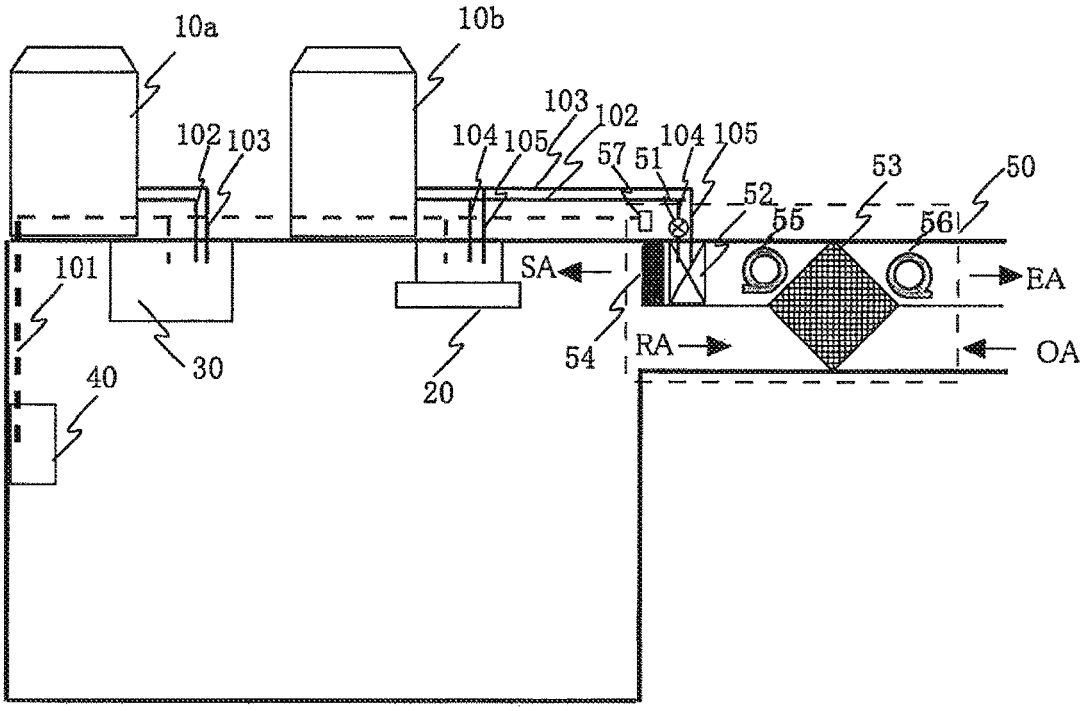
FIG. 13 is a diagram illustrating a configuration of an air-conditioning system according to Embodiment 4 of the invention.

FIG. 13 is a diagram illustrating a configuration of an air-conditioning system according to Embodiment 4 of the invention. In FIG. 13, an outdoor air treatment device 50 is added to the configuration of FIG. 11 that is described in Embodiment 2. In this embodiment, an outdoor unit 10*a*, an indoor unit 20, and the outdoor air treatment device 50 are connected to each other with a liquid main pipe 102, liquid branch pipes 104, a gas main pipe 103, and gas branch pipes 105 so as to constitute a refrigerant circuit. An outdoor unit 10*b* and a humidity control device 30 are connected to each other with a liquid main pipe 102 and a gas main pipe 103 so as to constitute another refrigerant circuit.

In this embodiment, the outdoor unit 10*a*, the outdoor unit 10*b*, the indoor unit 20, the humidity control device 30, a controller 40, and the outdoor air treatment device 50 are connected to each other with a transmission line 101 for communication, and can be controlled cooperatively as a system. Operations of controlling dehumidification and the evaporating temperature of the refrigerant in the indoor unit 20 and the humidity control device 30 are the same as those described in Embodiments 1 and 2.

Advantages of Embodiment 4

As described above, in the air-conditioning system of Embodiment 4, the humidity control device 30, and the outdoor air treatment device 50 and the indoor unit 20 are separately connected to the outdoor units 10*a* and 10*b*, respectively. Therefore, the evaporating temperature of the refrigerant on the humidity control device 30 side and the evaporating temperature of the refrigerant on the indoor unit side can be changed and thus the evaporating temperature of the refrigerant can be set only for the purpose of temperature control in the indoor unit 20. Accordingly, the evaporating temperature can be further increased in the indoor unit 20, and the efficiency can be increased.

Embodiment 5

Although the outdoor unit 10*b* and the humidity control device 30 are connected to each other with pipes so as to constitute a refrigerant circuit in the above Embodiments 2 and 4, a humidity control device into which the outdoor unit 10*b* and the humidity control device 30 are integrated may be provided.

REFERENCE SIGNS LIST

1*a* discharge pressure sensor;
1*b* suction pressure sensor;
2*a* liquid pipe temperature sensor;
2*b* gas pipe temperature sensor;
2*c* outdoor air temperature sensor;
2*d* inlet air temperature sensor;
3 temperature/humidity sensor;
10*a*, 10*b* outdoor unit;
11 compressor;

12 outdoor heat exchanger;
13 four-way valve;
14 accumulator;
15 outdoor unit air-sending means;
16 outdoor unit control means;
20 indoor unit;
21 indoor unit expansion valve;
22 indoor unit heat exchanger;
23 indoor unit air-sending means;
24 indoor unit control means;
30 humidity control device;
31 humidity control device expansion valve;
32 humidity control device heat exchanger;
33*a*, 33*b* water adsorption/desorption device;
34*a*, 34*b* air flow switching means;
35 humidity control device air-sending means;
36 humidity control device control means;
37 main body;
38 air inlet;
39 air outlet;
40 controller;
50 outdoor air treatment device;
51 outdoor air treatment device expansion valve;
52 outdoor air treatment device heat exchanger;
53 total heat exchanger;
54 humidifying means;
55 supply air sending means;
56 exhaust air sending means;
57 outdoor air treatment device control means;
101 transmission line;
102 liquid side main pipe;
103 gas side main pipe;
104 liquid side branch pipe;
105 gas side branch pipe;
OA outdoor air;
RA return air;
SA supply air; and
EA exhaust air.

The invention claimed is:

1. An air-conditioning system comprising: at least one outdoor unit including a compressor, a flow switching device, and an outdoor heat exchanger; at least one indoor unit including a first expansion device and a first indoor heat exchanger; and at least one humidity control device including a second expansion device, a second indoor heat exchanger, a humidity control device air-sending device, a first water adsorption/desorption device, and a second water adsorption/desorption device, wherein the compressor, the flow switching device, the outdoor heat exchanger, the first expansion device, the first indoor heat exchanger, the second expansion device, and the second indoor heat exchanger are connected to each other with pipes so as to constitute a refrigerant circuit, wherein, in the humidity control device, the first water adsorption/desorption device and the second water adsorption/desorption device are disposed in an air path providing communication between an air inlet through which air flows in from a humidity controlled space and an air outlet through which air flows out into the humidity controlled space, the first water adsorption/desorption device and the second water adsorption/desorption device each comprising a dehumidification element including an adsorbent whose equilibrium adsorption capacity with respect to air having a relative humidity in a range of 40% through 100% increase with an increase in the relative humidity, the second indoor heat exchanger is disposed between the first water adsorption/desorption device and the second water adsorption/desorption device in the air path, wherein the humidity control device further includes a switching device that switches between a first channel in which the air that has flowed in through the air inlet is caused to pass through the first water adsorption/desorption device, the second indoor heat exchanger, and the second water adsorption/desorption device in this order, and a second channel in which the air that has flowed in through the air inlet is caused to pass through the second water adsorption/desorption device, the second indoor heat exchanger, and the first water adsorption/desorption device in this order, and wherein the humidity control device air-sending device is configured to vary a volume of air and send the varied volume of air to the first water adsorption/desorption device and the second water adsorption/desorption device, and wherein, during a cooling operation, the humidity control device is configured to dehumidify air inhaled from the humidity controlled space and supply the air which was dehumidified to the humidity controlled space from where the air was inhaled.

2. The air-conditioning system of claim 1, further comprising at least one outdoor air treatment device including a third expansion device and a third indoor heat exchanger, wherein the third expansion device and the third indoor heat exchanger are further connected with the pipes so as to constitute the refrigerant circuit.

3. The air-conditioning system of claim 1, wherein the first water adsorption/desorption device and the second water adsorption/desorption device are fixed and remain stationary in an air path providing communication between an air inlet through which air flows in from a humidity controlled space and an air outlet through which air flows out into the humidity controlled space.

4. The air-conditioning system of claim 3, wherein the switching device includes a first branch part that is disposed upstream of the first water adsorption/desorption device and the second water adsorption/desorption device, and divides the air path into two branches; and a second branch part that is disposed downstream of the first water adsorption/desorption device and the second water adsorption/desorption device, and divides the air path into two branches.

5. The air-conditioning system of claim 1, wherein the first water adsorption/desorption device and the second water adsorption/desorption device are ventilation bodies each having a plurality of through holes.

6. The air-conditioning system of claim 1, wherein the second indoor heat exchanger is disposed between the first water adsorption/desorption device and the second water adsorption/desorption device in an air path providing communication between an air inlet through which air flows in from a humidity controlled space and an air outlet through which air flows out into the humidity controlled space, and wherein the first water adsorption/desorption device and the second water adsorption/desorption device are arranged such that air passage surfaces thereof face air passage surfaces of the second indoor heat exchanger, respectively.

7. The air-conditioning system of claim 1, wherein the second indoor heat exchanger is disposed between the first water adsorption/desorption device and the second water adsorption/desorption device in an air path providing communication between an air inlet through which air flows in from a humidity controlled space and an air outlet through which air flows out into the humidity controlled space, and wherein a direction in which the air that passes through the first water adsorption/desorption device, the second indoor heat exchanger, and the second water adsorption/desorption device is reversed by switching air channels in the air path.

8. An air-conditioning system comprising:

at least one first outdoor unit including a first compressor, a first flow switching device, and a first outdoor heat exchanger;

at least one second outdoor unit including a second compressor, a second flow switching device, and a second outdoor heat exchanger;

at least one indoor unit including a first expansion device and a first indoor heat exchanger; and at least one humidity control device including a second expansion device, a second indoor heat exchanger, a humidity control device air-sending device, a first water adsorption/desorption device, and a second water adsorption/desorption device, wherein the first compressor, the first flow switching device, the first outdoor heat exchanger, the first expansion device, and the first indoor heat exchanger are connected to each other with pipes so as to constitute a first refrigerant circuit, and wherein the second compressor, the second flow switching device, the second outdoor heat exchanger, the second expansion device, and the second indoor heat exchanger are connected to each other with pipes so as to constitute a second refrigerant circuit, wherein, in the humidity control device, the first water adsorption/desorption device and the second water adsorption/desorption device are disposed in an air path providing communication between an air inlet through which air flows in from a humidity controlled space and an air outlet through which air flows out into the humidity controlled space, the first water adsorption/desorption device and the second water adsorption/desorption device each comprising a dehumidification element including an adsorbent whose equilibrium adsorption capacity with respect to air having a relative humidity in a range of 40% through 100% increase with an increase in the relative humidity, the second indoor heat exchanger is disposed between the first water adsorption/desorption device and the second water adsorption/desorption device in the air path, wherein the humidity control device further includes a switching device that switches between a first channel in which the air that has flowed in through the air inlet is caused to pass through the first water adsorption/desorption device, the second indoor heat exchanger, and the second water adsorption/desorption device in this order, and a second channel in which the air that has flowed in through the air inlet is caused to pass through the second water adsorption/desorption device, the second indoor heat exchanger, and the first water adsorption/desorption device in this order, and wherein the humidity control device air-sending device is configured to vary a volume of air and send the varied volume of air to the first water adsorption/desorption device and the second water adsorption/desorption device, and wherein, during a cooling operation, the humidity control device is configured to dehumidify air inhaled from the humidity controlled space and supply the air which was dehumidified to the humidity controlled space from where the air was inhaled.

9. The air-conditioning system of claim 8, further comprising at least one outdoor air treatment device including a third expansion device and a third indoor heat exchanger, wherein the third expansion device and the third indoor heat exchanger are further connected with the pipes so as to constitute the first refrigerant circuit.

10. The air-conditioning system of claim 8, wherein the first water adsorption/desorption device and the second water adsorption/desorption device are fixed and remain stationary in an air path providing communication between an air inlet through which air flows in from a humidity controlled space and an air outlet through which air flows out into the humidity controlled space.

11. The air-conditioning system of claim 10, wherein the switching device includes a first branch part that is disposed upstream of the first water adsorption/desorption device and the second water adsorption/desorption device, and divides the air path into two branches; and a second branch part that is disposed downstream of the first water adsorption/desorption device and the second water adsorption/desorption device, and divides the air path into two branches.

12. The air-conditioning system of claim 8, wherein the first water adsorption/desorption device and the second water adsorption/desorption device are ventilation bodies each having a plurality of through holes.

13. The air-conditioning system of claim 8, wherein the second indoor heat exchanger is disposed between the first water adsorption/desorption device and the second water adsorption/desorption device in an air path providing communication between an air inlet through which air flows in from a humidity controlled space and an air outlet through which air flows out into the humidity controlled space, and wherein the first water adsorption/desorption device and the second water adsorption/desorption device are arranged such that air passage surfaces thereof face air passage surfaces of the second indoor heat exchanger, respectively.

14. The air-conditioning system of claim 8, wherein the second indoor heat exchanger is disposed between the first water adsorption/desorption device and the second water adsorption/desorption device in an air path providing communication between an air inlet through which air flows in from a humidity controlled space and an air outlet through which air flows out into the humidity controlled space, and wherein a direction in which the air that passes through the first water adsorption/desorption device, the second indoor heat exchanger, and the second water adsorption/desorption device is reversed by switching air channels in the air path.

15. A humidity control device comprising:

a compressor;

a condenser;

an expansion device;

a humidity control device air-sending device, a first water adsorption/desorption device and a second water adsorption/desorption device that are disposed in an air path providing communication between an air inlet through which air flows in from a humidity controlled space and an air outlet through which air flows out into the humidity controlled space, the first water adsorption/desorption device and the second water adsorption/desorption device each comprising a dehumidification element including an adsorbent whose equilibrium adsorption capacity with respect to air having a relative humidity in a range of 40% through 100% increases with an increase in the relative humidity;

an evaporator disposed between the first water adsorption/desorption device and the second water adsorption/desorption device in the air path; and a switching device that switches between a first channel in which the air that has flowed in through the air inlet is caused to pass through the first water adsorption/desorption device, the evaporator, and the second water adsorption/desorption device in this order, and a second channel in which the air that has flowed in through the air inlet is caused to pass through the second water adsorption/desorption device, the evaporator, and the first water adsorption/desorption device in this order, wherein the humidity control device air-sending device is configured to vary a volume of air and send the varied volume of air to the first water adsorption/desorption device and the second water adsorption/desorption device, and wherein, during a cooling operation, the humidity control device is configured to dehumidify air inhaled from the humidity controlled space and supply the air which was dehumidified to the humidity controlled space from where the air was inhaled.

* * * * *